US011000717B2

(12) United States Patent
Müller et al.

(10) Patent No.: US 11,000,717 B2
(45) Date of Patent: May 11, 2021

(54) SPRINKLER HEAD

(71) Applicant: JOB Lizenz GmbH & Co. KG, Ahrensburg (DE)

(72) Inventors: Bodo Müller, Tornesch (DE); Jürgen Teschner, Hamburg (DE); Rüdiger Klug, Ahrensburg (DE)

(73) Assignee: JOB LIZENZ GMBH & CO. KG, Hamburg (DE)

( * ) Notice: Subject to any disclaimer, the term of this patent is extended or adjusted under 35 U.S.C. 154(b) by 69 days.

(21) Appl. No.: 16/125,961

(22) Filed: Sep. 10, 2018

(65) Prior Publication Data

US 2019/0083833 A1 Mar. 21, 2019

(30) Foreign Application Priority Data

Sep. 20, 2017 (DE) ..... 202017105705.4

(51) Int. Cl.

| | |
|---|---|
| ***A62C 37/00*** | (2006.01) |
| ***A62C 37/36*** | (2006.01) |
| ***A62C 37/14*** | (2006.01) |
| ***A62C 31/00*** | (2006.01) |
| ***A62C 37/08*** | (2006.01) |

(52) U.S. Cl.

CPC ..... *A62C 37/04* (2013.01); *A62C 31/005* (2013.01); *A62C 37/08* (2013.01); *A62C 37/14* (2013.01)

(58) Field of Classification Search

CPC ..... A62C 37/04; A62C 37/08; A62C 37/10; A62C 37/11; A62C 37/12; A62C 37/14; A62C 37/16; A62C 37/40; A62C 31/05; A62C 35/605

See application file for complete search history.

(56) References Cited

U.S. PATENT DOCUMENTS

| | | | |
|---|---|---|---|
| 2,245,144 | A | 6/1941 | Griffith |
| 3,726,344 | A | 4/1973 | Rothman et al. |

(Continued)

FOREIGN PATENT DOCUMENTS

| | | |
|---|---|---|
| CN | 101175538 | 5/2008 |
| CN | 101670160 | 3/2010 |

(Continued)

*Primary Examiner* — Qingzhang Zhou

(74) *Attorney, Agent, or Firm* — Sand, Sebolt & Wernow Co., LPA

(57) ABSTRACT

A sprinkler head for a sprinkler system including a pipe section, a sealing member provided over a pipe section discharge opening, an abutment connected to the pipe section via a support element, and thermal release element disposed between the abutment and sealing member. A triggering means controls active thermal triggering of the thermal release element and includes an electrical circuit board having a controller, an electric power supply, and an electrical conduction path along the thermal release element. The electrical circuit board is in electrical contact with the sealing member and support element. The abutment and sealing member are electrically connected to the electrical conduction path. Current fed by the power supply through the support element, the abutment, the electric conduction path, and sealing member is produced by means of the controller, causes active heating and thus a triggering of the thermal release element.

16 Claims, 3 Drawing Sheets

(56) References Cited

U.S. PATENT DOCUMENTS

| | | | | |
|---|---|---|---|---|
| 5,315,292 | A * | 5/1994 | Prior | A62C 37/38 169/61 |
| 6,896,066 | B2 | 5/2005 | Gil | |
| 7,633,393 | B2 * | 12/2009 | Bonne | G08B 5/36 340/572.1 |
| 2002/0053440 | A1 | 5/2002 | Gil | |
| 2007/0240886 | A1 * | 10/2007 | Kil | A62C 37/11 169/39 |
| 2017/0120090 | A1 * | 5/2017 | Magnone | A62C 3/002 |
| 2017/0304664 | A1 * | 10/2017 | Tanklevski | A62C 37/11 |

FOREIGN PATENT DOCUMENTS

| | | |
|---|---|---|
| DE | 10056779 | 6/2002 |
| DE | 10056778 | 9/2002 |
| DE | 102005001717 | 7/2006 |
| DE | 202012100623 | 5/2012 |
| DE | 112015004296 | 8/2017 |
| EP | 2286879 | 2/2011 |
| RU | 2203706 | 5/2003 |
| RU | 2379080 | 1/2010 |
| RU | 2413553 | 3/2011 |
| WO | 0158531 | 8/2001 |
| WO | 0162345 | 8/2001 |
| WO | 2006060287 | 6/2006 |
| WO | 2016048190 | 3/2016 |

* cited by examiner

SPRINKLER HEAD

TECHNICAL FIELD

The invention relates to a sprinkler head having the features of a pipe section for a sprinkler liquid, wherein at a first end, the pipe section is configured for connection to a coupler of a sprinkler pipeline of a sprinkler system and at a second end has a discharge opening, a sealing member made of an electrically conductive material and cooperating with a seal for sealing off the discharge opening of the pipe section, an abutment section rigidly connected to the pipe section via a support element, wherein the support element and the abutment section are made of electrically conductive material and are electrically conductively connected to one another, a thermal release element disposed between the abutment section and the sealing member such that in a normal position, the sealing member is held by the thermal release element in a position in which it cooperates with the seal to seal off the discharge opening of the pipe section, and such that in a triggered position, in which the thermal release element has been thermally triggered, the sealing member is released from its position in which it seals off the discharge opening of the pipe section, wherein triggering means for the controlled active thermal triggering of the thermal release element by actively heating the thermal release element are provided.

BACKGROUND

Background Information

Sprinkler systems have been used for many decades for protecting against and extinguishing fires in buildings. Such sprinkler systems typically comprise a storage tank containing pressurized sprinkler liquid and a system of lines or pipes that are connected to the storage tank and include distribution lines or distribution pipes, which terminate in ceiling areas of spaces to be protected, where sprinkler heads are then inserted. Such sprinkler heads have valves, which are closed under normal circumstances and which open when the system is triggered, releasing the sprinkler liquid. Typically, the sprinkler heads also have deflector and distributor plates for deflecting and distributing the pressurized sprinkler liquid, enabling a large area to be wetted with the sprinkler liquid.

The valves of these sprinkler heads are typically kept sealed by thermal release elements, which are positioned between an abutment section designed for supporting said release elements and a sealing member of the valve, and thus under normal circumstances keep the valve and therefore also the outlet for the sprinkler liquid sealed. As the heat of a fire builds up, the thermal release elements become heated to an actuating temperature at which they are triggered, releasing the sealing members and opening up the respective valve and thus the outlet for the sprinkler liquid. Typical thermal release elements may comprise, in particular, support elements made of a fusible solder, or glass ampoules, also called glass vessels, which are filled with an actuating liquid and typically also with a gas bubble. These release elements are actuated when, on heating, the thermal actuating liquid expands, building up pressure inside the glass vessel, which ultimately causes the wall of the glass vessel to burst, destroying the glass ampoule.

The actuating principle described above functions purely passively, in other words, the sprinkler head, more precisely the thermal release element arranged thereon, responds to an increase in the ambient temperature, which typically occurs as a result of a fire.

According to some considerations that have already found their way into practical implementation, however, sprinkler systems or parts thereof can also be triggered actively, so that when a fire or fire source is detected, sprinkler heads in an area surrounding the fire source can be opened and released to allow the discharge of sprinkler liquid by actively triggering the thermal release elements. In many cases such active, often remote-controlled actuation is carried out electrically, for example by deliberately heating the thermal release element. Such remote actuation is described, for example, in DE 100 56 778 A1 and DE 100 56 779 A1, but also in DE 10 2005 001 717 A1.

The general ability to actively control and actuate sprinkler heads has proven highly effective and extremely useful for protecting against and extinguishing fires. One problem of prior art systems, however, is that they require wiring, since they are dependent both on an external power supply and on a wired connection to a higher-level control system via which the actuation, in particular, is triggered. This requirement not only involves the added expense of installing appropriate supply and communication lines with the initial set up of a corresponding sprinkler system. It has also proven cumbersome particularly in connection with a possible retrofitting of such an active release option into existing sprinkler systems. In such cases, it is frequently extremely difficult to install appropriate cable connections, or at the very least such installation is associated with very high cost.

SUMMARY

The object of the present invention is to remedy this situation and to provide a sprinkler head which includes an active actuation option without the need for complex wiring, and which can, in particular, be easily retrofitted into existing sprinkler systems.

This object is attained according to the invention by a sprinkler head having a triggering means that comprises an electrical circuit board on which a controller is arranged, and an electric power supply, and an electrical conduction path having an electrical resistance along the thermal release element, wherein the electrical circuit board has a top side and an bottom side, and on a first of its sides, top side or bottom side, is in electrical contact with the sealing member, and on a second of its sides, top side or bottom side, is in electrical contact with the support element, wherein the abutment section and the sealing member are each electrically connected to the electrical conduction path leading along the thermal release element, so that a flow of current fed by the electric power supply through the support element, the abutment section, the electric conduction path guided along the thermal release element, and the sealing member can be produced by means of the controller on the circuit board, causing an active heating and thus a triggering of the thermal release element. Advantageous refinements of such a sprinkler head include that a communications interface for wireless communication of the controller with a digital counterpart is arranged on the electrical circuit board. The thermal release element is a glass ampoule filled with a triggering liquid, wherein the conduction path is formed by an electrically conductive coating or an electrically conductive collar on an outer surface of the glass ampoule and/or comprises an electrical conductor guided inside the glass ampoule. The electrical circuit board is clamped with contact sections on its top side and on its bottom side between clamping sections of the sealing member and the support element and is held there in electrical contact. Furthermore, controller is configured to conduct a measuring current via the circuit formed by support element, abutment section, electrical conduction path leading along the thermal release element, and sealing member, in order to deduce the status of the thermal release element from the determined current flow and/or voltage. The sprinkler head may include a deflector and distributor plate for distributing the sprinkler liquid. The size and shape of the electrical circuit board, in particular its outer contour, will not hinder the desired distribution of the sprinkler liquid in the event of release. A spring element is arranged between the support element and the sealing member, wherein in regions in which the spring element bears against the support element and/or in regions in which the spring element bears against the sealing member, electrical insulation is provided.

According to the invention, a sprinkler head for a sprinkler system includes a pipe section for a sprinkler liquid, a first end of this pipe section being configured for connection to a coupler of a sprinkler pipeline of a sprinkler system (e.g. with a screw thread), and a second end of this pipe section having a discharge opening. In addition, the sprinkler head according to the invention has a sealing member, made of an electrically conductive material and cooperating with a seal, for sealing off the discharge opening of the pipe section. The sprinkler head is further equipped with an abutment section which is rigidly connected to the pipe section via a support element, the support element and the abutment section being made of electrically conductive material and being electrically conductively connected to one another. The sprinkler head according to the invention additionally contains a thermal release element, located between the abutment section and the sealing member in such a way that in a normal position, the sealing member is held by the thermal release element in a position in which it cooperates with the seal to seal off the discharge opening of the pipe section, in other words sealing it tightly to prevent any discharge of sprinkler liquid, and such that in a triggered position, in which the thermal release element has been thermally triggered, the sealing member is released from its position in which it seals off the discharge opening of the pipe section. Further provided are triggering means for the controlled active thermal triggering of the thermal release element by active heating of the thermal release element.

The inventive innovation of the sprinkler head is that the triggering means comprises an electrical circuit board on which a controller is mounted, along with an electric power supply and an electrical conduction path having an electrical resistance along the thermal release element, wherein the electrical circuit board has a top side and a bottom side, and on a first of its sides, top side or bottom side, the circuit board is in electrical contact with the sealing member, and on the second of its sides, top side or bottom side, it is in electrical contact with the support element, wherein the abutment section and the sealing member are each electrically connected to the electrical conduction path leading along the thermal release element, so that by means of the controller on the circuit board, a flow of current fed by the electric power supply through the support element, the abutment section, the electric conduction path leading along the thermal release element, and the sealing member can be produced, which results in the active heating and thus the triggering of the thermal release element. The release element is actively heated, in particular, by the heat generated by the electrical resistance of the conduction path through which the current flows.

The sprinkler head according to the invention is characterized in that the electrical circuit board is located on the sprinkler head itself and includes the electric power supply, which may be formed for example by a battery or a rechargeable battery, for example a button cell battery, independently of an external electric power supply, and can thus be used independently. Said sprinkler head is therefore also suitable in particular for retrofitting into existing sprinkler systems, without having to install new electric power supply lines there, for example. The design concept of the sprinkler head according to the invention is also simple, in particular in that the circuit that is completed for an active triggering of the thermal release element does not require its own cable and is formed solely by electrically conductive elements of the sprinkler head and corresponding conductive tracks on the circuit board. This particular circumstance results in a simple and very robust construction of the sprinkler head according to the invention, enabling the sprinkler head not only to be produced inexpensively, but in particular, to be used malfunction-free and with low maintenance over a long period of time, which is of particular importance considering the long service life of such sprinkler heads. To maintain the option of actively triggering the sprinkler head, it is necessary only to ensure that the supply of electric power on the printed circuit board is always filled with sufficient electric power for the active thermal triggering to function.

With particular advantage, to integrate the sprinkler head according to the invention into a higher-level system for controlling active triggering (remote triggering), it may be provided that a communications interface for wireless communication between the controller and a digital counterpart is located on the electrical circuit board. Such a communications interface may be an interface according to the WLAN standard, for example, but may also be an interface for communication by means of mobile radio technology (e.g. UMTS or LTE) or via standardized transmission protocols from the fire alarm industry or the like. As mentioned above, the provision of such a wireless communications interface thus enables the sprinkler head according to the invention to be integrated into a higher-level fire extinguishing system without wiring with respect to data lines or bus lines. In this way systems can be created, for example, that detect a fire source via smoke detectors and then initiate, controlled via a central alarm or management console, a remote triggering of sprinkler heads located in the area surrounding the fire source, all by means of wireless communication.

The fact that the thermal release element can continue to be triggered passively by an increased ambient temperature ensures that in the event of a communications failure or in the event of a failure of active triggering, for example if the electric power supply on the circuit board is no longer sufficiently charged, the sprinkler head will still be triggered passively in the traditional manner when the ambient air becomes heated due to a fire and the temperature rises above a triggering temperature of the thermal release element.

Advantageously, the thermal release element in the sprinkler head according to the invention may be a glass ampoule filled with a triggering liquid, in which case the conduction path is formed by an electrically conductive coating or an electrically conductive collar on an outer surface of the glass ampoule, and/or comprises an electrical conductor guided inside the glass ampoule. In particular, the electrical resistance of the conduction path is selected such that upon application of a triggering current, this conduction path is heated to such a temperature that the triggering temperature of the glass ampoule is reached or exceeded as a result.

The electrical circuit board can, in particular, be clamped with contact sections on its top side and on its bottom side between clamping sections of the sealing member and the support element and held there electrically contacted. The support element need not necessarily be a separate part that is structurally separated or separable from the rest of the sprinkler head, for example it may be formed integrally with the pipe section or with walls delimiting said section, so that these walls of the pipe section can also be considered as part of the support element. The abutment section can also be formed integrally with the support element. Support element and sealing member may be made, for example, of brass, copper, steel, or some other electrically conductive metal. The circuit board is formed with conductive tracks on both sides, with contact areas being formed on both the top and the bottom side of each of the conductor tracks, which contact areas, in the solution as described, are clamped between support element and sealing member and thereby each electrically contact one of these elements, thereby forming a circuit which leads over the electrically conductive conduction path along the thermal release element. In the configuration as described above, this results not only in a particularly simple electrical contacting of the circuit board. The circuit board can also be held in position mechanically by clamping. However, the printed circuit board may also be held in position mechanically by additional means, if necessary.

In addition to the possibility of remote tripping, which can be triggered by the controller, which produces a corresponding current flow, the sprinkler head according to the invention can also provide a possibility for the controller to conduct a measuring current via the circuit formed by the support element, abutment section, electrical line path guided along the thermal release element, and sealing member in order to deduce a state of the thermal release element from the determined current flow and/or voltage. In the simplest case, an interruption of the current flow can indicate that the thermal release element has been tripped. This circumstance can then be interpreted as an indication of a source of fire in the region of the affected sprinkler head, and this signal can be made available to a higher-level control system, where it can be used to actively trip sprinkler heads located in the vicinity of the affected sprinkler head if necessary. However, a more detailed evaluation can also be carried out, for example a change in the current flow at the same applied voltage or a change in the decreasing voltage at the same current flow, which in turn can be interpreted as the formation of a crack in a glass ampoule or the like. The sprinkler head formed in this way can then send a signal by means of the control unit on the electrical printed circuit board that a defect is present and maintenance is required. This signal can be sent, for example, via a wireless communications interface, which is advantageously provided as described above.

The sprinkler head according to the invention can advantageously include a baffle and distribution plate for distributing the sprinkler liquid, as is also known from the prior art of sprinkler heads. Such a baffle and distribution plate serves in particular to distribute the sprinkler liquid initially flowing frontally over a correspondingly large area in order to wet a large area with the sprinkler liquid, to prevent fire or to suppress a fire that has developed in said area with the sprinkler liquid.

The size and shape of the electrical printed circuit board, in particular its outer contour, advantageously does not hinder the desired distribution of the sprinkler liquid in the event of tripping. Thus, if a baffle and distribution plate is provided, for example, the outer contour of the printed circuit board is dimensioned such that sprinkler liquid rebounding from the baffle and distribution plate does not strike the printed circuit board and thus impairs the distribution pattern of the sprinkler liquid.

In sprinkler heads, the closure bodies are typically mounted floating, for example to account for changes in length of the thermal release elements caused by different temperatures, without impairing the function of the sprinkler head. For this purpose, spring elements are arranged between the sealing member and an edge of the pipe section in the area of the discharge opening which usually already forms part of the support element. This can also be the case with the sprinkler head according to the invention, in which case, to prevent an electrical short circuit, appropriate insulations must be provided which prevent an electrical line between the sealing member and support element via the spring element.

BRIEF DESCRIPTION OF THE SEVERAL VIEWS OF THE DRAWINGS

Further advantages and features of the invention will be apparent from the following description of exemplary embodiments, in which reference is made to the attached figures. Shown in these figures are.

Figure 1:
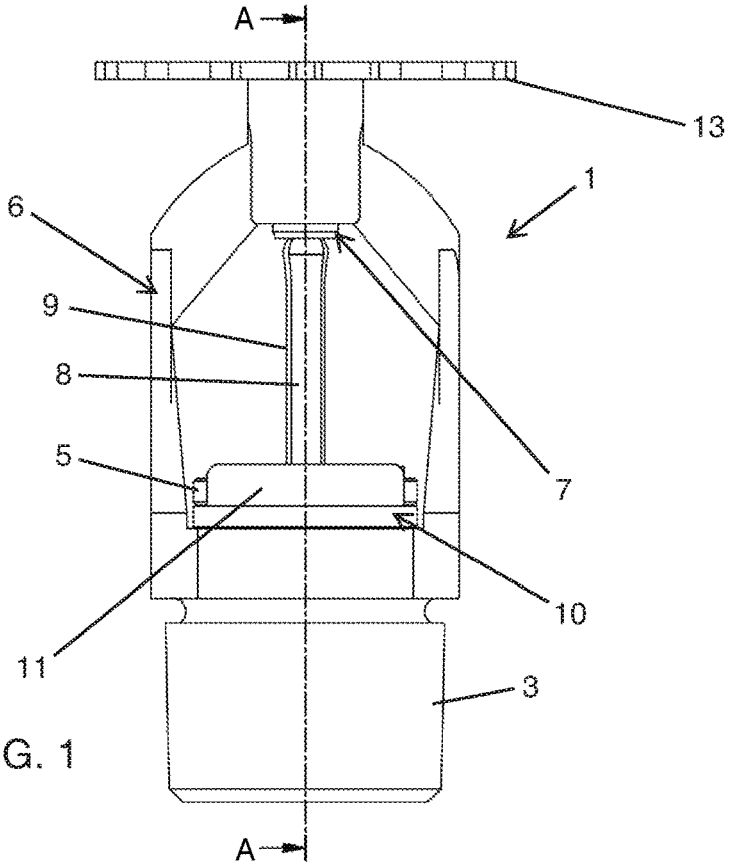
FIG. 1 a schematic side view of a sprinkler head configured according to the invention, in a first exemplary embodiment.
Figure 2:
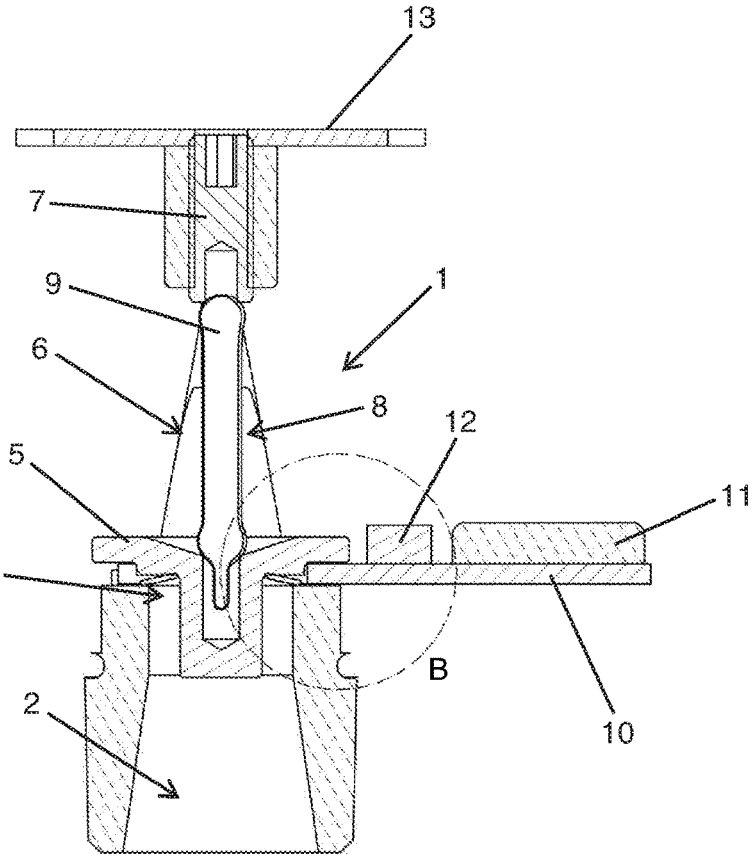
FIG. 2 a longitudinal section of the sprinkler head of FIG. 1, taken along the intersection line A-A of FIG. 1 and viewed in the direction of the arrows marked along the cutting line.
Figure 3:
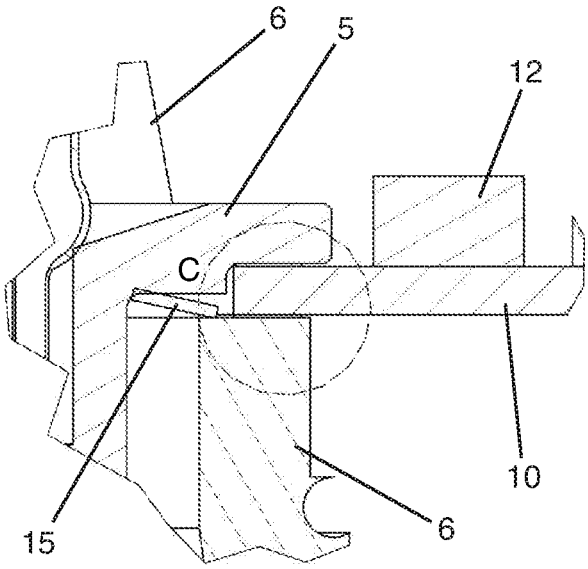
FIG. 3 an enlarged illustration of the encircled area marked B in FIG. 2.

The figures show schematic illustrations of possible design variants of the invention which serve to explain the invention and are by no means true to scale or detailed in all respects. In the figures—including in the various embodiments—identical or identically functioning parts are denoted by identical reference signs.

DETAILED DESCRIPTION

To begin with, a first design variant of a sprinkler head 1 according to the invention will be described, with reference to FIGS. 1 to 4. Sprinkler head 1 has a largely integrally formed body in which a pipe section 2 for a sprinkler liquid is formed and which includes a support element 6 in which an abutment section 7 is arranged. Pipe section 2 is surrounded by a substantially cylindrical wall, which is provided with an external thread 3, on a side located at a first end of the pipe section 2, to enable said pipe section to be screwed into an open pipe end of a sprinkler pipe or into a pipeline end of a sprinkler pipeline, which is provided with a corresponding internal thread. At a second end axially opposite the first end, pipe section 2 is provided with a discharge opening 4 from which sprinkler liquid is discharged from sprinkler head 1 in the event of actuation. This discharge opening 4 is sealed by a sealing member 5, which cooperates with a sealing element in such a way, as described in more detail below, that when the sprinkler head is coupled to a sprinkler pipe or to a sprinkler pipeline and when sprinkler liquid is present in pipe section 2, the liquid cannot escape through the discharge opening 4. Sealing member 5 is held in this sealing position by a thermal release element 8 clamped axially between abutment section 7 and sealing member 5, the thermal release element 8 in this exemplary embodiment being a closed glass ampoule filled with a thermal actuating liquid. Such glass ampoules are sufficiently well known and are even produced in large quantities by this applicant, for example. Thus, there is no need for a detailed description of the general structure and functioning of said ampoules.

The thermal release element 8 in the form of a glass ampoule is provided with an electrically deposited coating 9 applied to its surface, which extends lengthwise over the thermal release element 8 in the form of a glass ampoule. In particular, support element 6 and the abutment section 7 inserted therein, in this case screwed therein, are made of an electrically conductive metal, the abutment section 7 being screwed into support element 6 so as to produce an electrical connection between these two components. Sealing member 5 is likewise made of an electrically conductive metal. These elements may be made of brass, in particular, but they may also be made of various other electrically conductive materials, in particular metals, such as copper or steel. As is clear from FIG. 3 in particular, a spring element in the form of a disk spring 15 is inserted between sealing member 5 and an outer wall, which extends around pipe section 2 and which is considered a part of support element 6. This spring element maintains a preload in the axial direction on the thermal release element in the form of glass ampoule 8 by pressing it against abutment section 7 with a predetermined force. Furthermore, disk spring 15, which is provided here with a coating of a non-conductive and seal-producing material, for example a Teflon coating, provides for a sealing of pipe section 2 in the region of discharge opening 4, which is sealed off by sealing member 5. In addition, due to its electrically insulating coating, the coated disk spring number 15 in its intermediate position insulates sealing member 5 electrically against support element 6 along this mechanical connection, which—as will be described later—is of essential significance to the invention.

Figure 4:
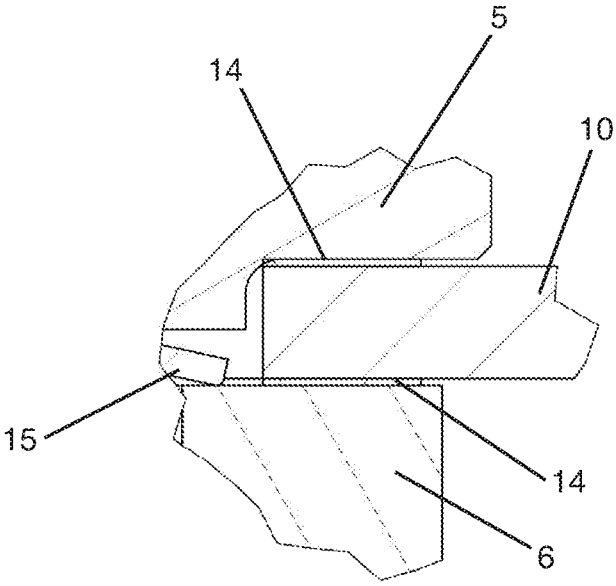
FIG. 4 an enlarged illustration of the encircled area marked C in FIG. 3.

Another component of sprinkler head 1 according to the invention is a circuit board 10, which may be designed in particular in the form of a conventional printed circuit board or PCB (printed circuit board) and which is equipped with a controller, symbolized here in the form of a chip 12, and with an electric power supply, represented here in the form of a battery 11. As FIG. 4 shows, in particular, circuit board 10 is provided with contact areas denoted by number 14 on its top side and on its bottom side, with circuit board 10 electrically contacting sealing member 5 with one of the contact areas 14 and electrically contacting support element 6 with another of the contact areas 14. The contact areas 14 are connected, in a manner not detailed here, to conductor tracks which are formed on circuit board 10 and via which an electric voltage supplied by battery 11 can be applied, switched via controller 12. Due to this applied electric voltage between the opposing contact areas 14, an electric current can then flow through support element 6, abutment section 7, electrically conductive coating 9, and sealing member 5. This electric current can be selected by controller 12 such that, due to the resistance of electrical coating 9, the current heats the thermal release element 8 in the form of the glass ampoule to an actuating temperature or beyond, so that it is actuated, i.e. in the case of the glass ampoule, the pressure built up in the actuating liquid causes the ampoule to burst, thereby releasing sealing member 5, which then, also driven along by the spring force of the disk spring number 15, moves away from discharge opening 4, thereby opening up the path for discharge of the sprinkler liquid. The sprinkler liquid then strikes a deflector and distributor plate 13, which ensures that the sprinkler fluid is distributed over a large area in a known manner. To ensure that the electric current actually flows through the electrically conductive coating 9 on thermal release element 8, the electrical insulation between sealing member 5 and support element 6 in the region of disk spring 15 therebetween is of great importance; otherwise, an electrically conductive connection formed there would result in a short-circuit.

Thus, clearly an embodiment of a sprinkler head 1 is provided here which, controlled by controller 12, is capable of independently effecting an active actuation of thermal release element 8 by conducting current through the electrically conductive coating 9 on the glass ampoule via the circuit as described above, which current leads to heating and thus to an active thermal triggering of release element 8 due to the electrical resistance of coating 9. In this exemplary embodiment, controller 12 is advantageously connected to a wireless communications interface (not shown here in detail), via which data can be exchanged, advantageously bidirectionally, with a corresponding counterpart. Via this wireless communications interface, controller 12 can receive an actuation command, for example, in response to which it switches the current flow as described above, thereby effecting the actuation of the sprinkler head by actuating thermal release element 8.

It may also be provided that, by means of controller 12, a current that is below the current intensity required to trigger thermal release element 8 can be transmitted via the circuit as described above and can be used as a detection current or measuring current to obtain information about the state of thermal release element 8, in particular to determine, for example, whether said release element is intact or has already been triggered or may be defective. Results obtained from such measurements can in turn be made available by controller 12 to a higher-level system via the wireless communications interface not shown here. Controller 12 can likewise emit a signal, for example, if the electrical energy stored in battery 11 falls below a critical threshold, indicating the need to replace battery 11.

Figure 5:
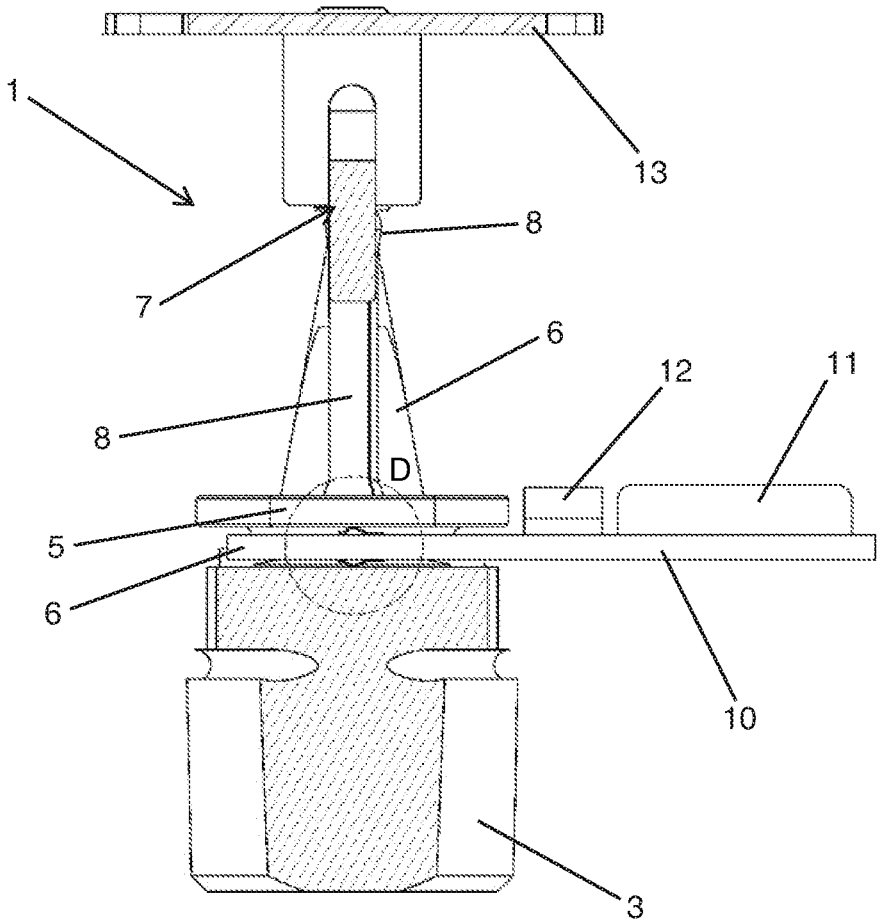
FIG. 5 a partially cut away schematic side view of a sprinkler head according to the invention, in a second exemplary embodiment.
Figure 6:
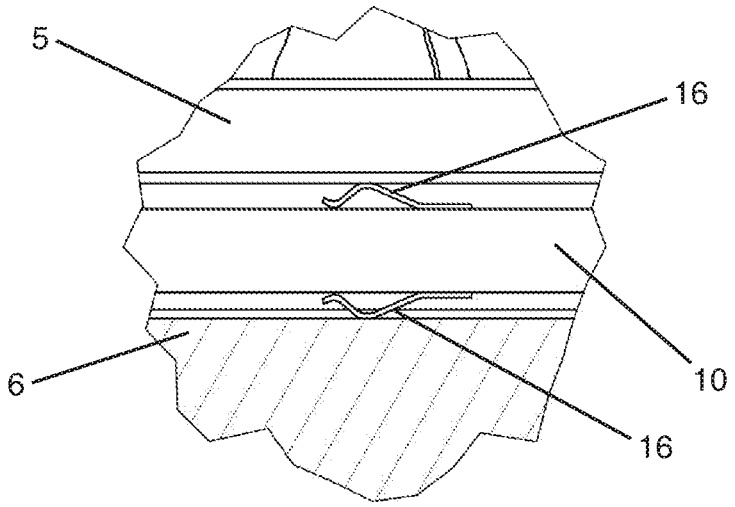
FIG. 6 an enlarged illustration of the encircled area marked D in FIG. 5.

FIGS. 5 and 6 show an alternative design variant in which the configuration and the circuit to be formed are basically identical to those described above, so that reference may be made to the above description in this regard. The only difference here is that the electrical contacting of circuit board 10 to the elements sealing member 5 and support element 6 is different. In this case, contact springs number 16 are arranged on the two opposing sides of circuit board 10 and press against the respective elements to be contacted with a mechanical contact pressure. The advantage of such an arrangement is that circuit board 10 does not necessarily have to be mechanically clamped between sealing member 5 and support element 6 to ensure a reliable electrical contact. It can, for example, be pushed laterally into an existing slot, in which case the contact springs 16 provide a mechanical hold and reliable electrical contact. This electrical contact can be maintained even if a certain displacement of sealing member 5 relative to support element 6 results due to thermal expansion, for example.

From the above description of exemplary embodiments, it has once again become clear that the sprinkler head of the invention, formed as a compact unit, is simple in configuration and is ideally suited for integration into a system that offers additional functions for extinguishing fires or for preventively charging spaces in the vicinity of a fire source with sprinkler liquid by actively triggering individual sprinkler heads. Above all, however, the capability of passive triggering of the sprinkler head continues to remain unaffected. Here, the function is identical to that of conventional, purely passively triggered sprinkler heads. Thus, if the ambient temperature exceeds a critical temperature, in particular if it reaches or even exceeds the range of the triggering temperature of thermal release element 8, this temperature increase will trigger the thermal release element 8, so that the discharge opening 4 of pipe section 2 is opened and sprinkler liquid, which reaches said discharge opening via the sprinkler line to which sprinkler head 1 is connected, can be discharged.

It is further apparent that the sprinkler head 1 of the invention is particularly well suited for retrofitting into existing sprinkler systems that do not yet offer the option of active triggering of the sprinkler heads. This retrofitting can be accomplished, in particular, without having to install extra electrical supply lines or electrical communication lines for this purpose (particularly if printed circuit board 10 is equipped with a wireless communications interface).

LIST OF REFERENCE SIGNS

1 sprinkler head
2 pipe section
3 external thread
4 discharge opening
5 sealing member
6 support element
7 abutment section
8 thermal release element
9 electrically conductive coating
10 electrical circuit board
11 battery
12 chip
13 deflector and distributor plate
14 contact area
15 disk spring
16 contact spring

The invention claimed is:

1. A sprinkler head for a sprinkler system, comprising:

a pipe section for a sprinkler liquid, wherein at a first end the pipe section is configured for connection to a coupler of a sprinkler pipeline of the sprinkler system; and wherein at a second end the pipe section has a discharge opening;

a sealing member made of an electrically conductive material and cooperating with a seal for sealing off the discharge opening of the pipe section;

an abutment section rigidly connected to the pipe section via a support element, wherein the support element and the abutment section are made of electrically conductive material and are electrically conductively connected to one another;

a thermal release element disposed between the abutment section and the sealing member such that in a normal position, the sealing member is held by the thermal release element in a position in which the sealing member cooperates with the seal to seal off the discharge opening of the pipe section, and such that in a triggered position in which the thermal release element has been thermally triggered, the sealing member is released from the position in which the sealing member seals off the discharge opening of the pipe section;

wherein a triggering means for a controlled active thermal triggering of the thermal release element by actively heating the thermal release element is provided, and the triggering means comprises:

an electrical circuit board on which a controller is arranged, wherein the electrical circuit board is provided directly on the sprinkler head, wherein the electrical circuit board has a top side and a bottom side, and one of the top side and the bottom side is in electrical contact with the sealing member and the other of the top side and the bottom side is in electrical contact with the support element;

an electric power supply provided directly on the circuit board;

an electrical conduction path having an electrical resistance along the thermal release element;

wherein the abutment section and the sealing member are each electrically connected to the electrical conduction path leading along the thermal release element so that a flow of current fed by the electric power supply through the support element, the abutment section, the electrical conduction path guided along the thermal release element, and the sealing member is produced by the controller on the electrical circuit board causing an active heating and thus a triggering of the thermal release element.

2. The sprinkler head according to claim 1, further comprising a communications interface for wireless communication of the controller with a digital counterpart arranged on the electrical circuit board.

3. The sprinkler head according to claim 1, wherein the thermal release element is a glass ampoule filled with a triggering liquid, and wherein the electrical conduction path is formed by one of an electrically conductive coating and an electrically conductive collar provided on an outer surface of the glass ampoule and an electrical conductor guided inside the glass ampoule.

4. A sprinkler head for a sprinkler system, comprising:

a pipe section for a sprinkler liquid, wherein at a first end the pipe section is configured for connection to a coupler of a sprinkler pipeline of the sprinkler system; and wherein at a second end the pipe section has a discharge opening;

a sealing member made of an electrically conductive material and cooperating with a seal for sealing off the discharge opening of the pipe section;

an abutment section rigidly connected to the pipe section via a support element, wherein the support element and the abutment section are made of electrically conductive material and are electrically conductively connected to one another;

a thermal release element disposed between the abutment section and the sealing member such that in a normal position, the sealing member is held by the thermal release element in a position in which the sealing member cooperates with the seal to seal off the discharge opening of the pipe section, and such that in a triggered position in which the thermal release element has been thermally triggered, the sealing member is released from the position in which the sealing member seals off the discharge opening of the pipe section;

wherein a triggering means for a controlled active thermal triggering of the thermal release element by actively heating the thermal release element is provided, and the triggering means comprises:

an electrical circuit board on which a controller is arranged; wherein the electrical circuit board has a top side and a bottom side, wherein one of the top side and the bottom side is in electrical contact with the sealing member and the other of the top side and the bottom side is in electrical contact with the support element; and wherein the electrical circuit board is clamped with contact sections on the top side of the electrical circuit board and on the bottom side of the electrical circuit board between clamping sections of the sealing member and the support element and is held thereby in electrical contact with the sealing member;

an electric power supply; and an electrical conduction path having an electrical resistance along the thermal release element;

wherein the abutment section and the sealing member are each electrically connected to the electrical conduction path leading along the thermal release element so that a flow of current fed by the electric power supply through the support element, the abutment section, the electrical conduction path guided along the thermal release element, and the sealing member is produced by the controller on the electrical circuit board causing an active heating and thus a triggering of the thermal release element.

5. The sprinkler head according to claim 1, wherein the controller is configured to conduct a measuring current via a circuit formed by the support element, the abutment section, the electrical conduction path leading along the thermal release element, and the sealing member in order to deduce a status of the thermal release element from one or more of a determined current flow and voltage.

6. The sprinkler head according to claim 1, further comprising a deflector and a distributor plate for distributing the sprinkler liquid.

7. The sprinkler head according to claim 1, wherein a size and a shape of the electrical circuit board will not hinder a desired distribution of the sprinkler liquid in the event of release.

8. The sprinkler head according to claim 1, further comprising a spring element arranged between the support element and the sealing member, and wherein electrical insulation is provided in regions in which the spring element bears against the support element and in regions in which the spring element bears against the sealing member.

9. The sprinkler head according to claim 1, wherein an outer contour of the electrical circuit board will not hinder a desired distribution of the sprinkler liquid in the event of release.

10. The sprinkler head according to claim 4, further comprising a communications interface for wireless communication of the controller with a digital counterpart arranged on the electrical circuit board.

11. The sprinkler head according to claim 4, wherein the thermal release element is a glass ampoule filled with a triggering liquid, and wherein the electrical conduction path is formed by one of an electrically conductive coating and an electrically conductive collar provided on an outer surface of the glass ampoule and an electrical conductor guided inside the glass ampoule.

12. The sprinkler head according to claim 4, wherein the controller is configured to conduct a measuring current via a circuit formed by the support element, the abutment section, the electrical conduction path leading along the thermal release element, and the sealing member in order to deduce a status of the thermal release element from one or more of a determined current flow and voltage.

13. The sprinkler head according to claim 4, further comprising a deflector and a distributor plate for distributing the sprinkler liquid.

14. The sprinkler head according to claim 4, wherein a size and a shape of the electrical circuit board will not hinder a desired distribution of the sprinkler liquid in the event of release.

15. The sprinkler head according to claim 4, further comprising a spring element arranged between the support element and the sealing member, and wherein electrical insulation is provided in regions in which the spring element bears against the support element and in regions in which the spring element bears against the sealing member.

16. The sprinkler head according to claim 4, wherein an outer contour of the electrical circuit board will not hinder a desired distribution of the sprinkler liquid in the event of release.

* * * * *